US008740366B1

(12) United States Patent
Palone et al.

(10) Patent No.: US 8,740,366 B1
(45) **Date of Patent: *Jun. 3, 2014**

(54) PRINTHEAD INCLUDING COANDA CATCHER WITH GROOVED RADIUS

(71) Applicants: Thomas W. Palone, Rochester, NY (US); Kathleen M. Vaeth, Penfield, NY (US); Kam C. Ng, Rochester, NY (US)

(72) Inventors: Thomas W. Palone, Rochester, NY (US); Kathleen M. Vaeth, Penfield, NY (US); Kam C. Ng, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/792,367

(22) Filed: Mar. 11, 2013

(51) Int. Cl.
*B41J 2/185* (2006.01)

(52) U.S. Cl.
USPC ..... 347/90

(58) Field of Classification Search
USPC ..... 347/73–82, 90
See application file for complete search history.

(56) References Cited

U.S. PATENT DOCUMENTS

| | | | | |
|---|---|---|---|---|
| 3,813,675 | A | 5/1974 | Steffy et al. | |
| 3,836,914 | A | 9/1974 | Duffield | |
| 3,936,135 | A | 2/1976 | Duffield | |
| 4,460,903 | A | 7/1984 | Guenther et al. | |
| 4,667,207 | A * | 5/1987 | Sutera et al. | 347/90 |
| 5,105,205 | A * | 4/1992 | Fagerquist | 347/90 |
| 6,457,807 | B1 | 10/2002 | Hawkins et al. | |
| 6,481,835 | B2 | 11/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,648,461 | B2 * | 11/2003 | Long | 347/90 |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 2008/0284835 | A1 * | 11/2008 | Panchawagh et al. | 347/90 |

FOREIGN PATENT DOCUMENTS

| | | |
|---|---|---|
| EP | 1 013 425 | 6/2000 |

* cited by examiner

*Primary Examiner* — Kristal Feggins
(74) *Attorney, Agent, or Firm* — William R. Zimmerli

(57) ABSTRACT

A printhead includes a jetting module, deflection mechanism, and catcher. The jetting module includes a nozzle array extending along a length of the jetting module. The jetting module forms drops travelling along a first path from liquid jets emitted from the nozzles. The deflection mechanism causes selected liquid drops formed by the jetting module to deviate from the first path to a second path. The catcher, positioned to intercept liquid drops travelling along one of the paths, includes a drop contact surface and a liquid removal conduit connected in fluid communication by a Coanda surface including a radial surface including an array of grooves. The liquid removal conduit includes a surface that is positioned opposite and spaced apart from the radial surface such that the opposite surface of the liquid removal conduit does not contact the radial surface that includes the array of grooves.

19 Claims, 10 Drawing Sheets

PRINTHEAD INCLUDING COANDA CATCHER WITH GROOVED RADIUS

CROSS REFERENCE TO RELATED APPLICATIONS

Reference is made to commonly-assigned, U.S. patent application Ser. No. 13/792,329, entitled "PRINTHEAD INCLUDING COANDA CATCHER WITH GROOVED RADIUS", Ser. No. 13/792,338, entitled "PRINTHEAD INCLUDING COANDA CATCHER WITH GROOVED RADIUS", Ser. No. 13/792,358, entitled "PRINTHEAD INCLUDING COANDA CATCHER WITH GROOVED RADIUS", all filed concurrently herewith.

FIELD OF THE INVENTION

This invention relates generally to the field of digitally controlled printing devices, and in particular to catchers of continuous liquid jetting systems.

BACKGROUND OF THE INVENTION

Traditionally, inkjet printing is accomplished by one of two technologies referred to as "drop-on-demand" and "continuous" printing. In both, liquid, such as ink, is fed through channels formed in a print head. Each channel includes a nozzle from which droplets are selectively extruded and deposited upon a recording surface.

Continuous liquid printing uses a pressurized liquid source that produces a stream of drops some of which are selected to contact a print media while other are selected to be collected and either recycled or discarded. For example, when no print is desired, the drops (commonly referred to as non-print drops) are deflected into a capturing mechanism (commonly referred to as a catcher, interceptor, or gutter) and either recycled or discarded. When printing is desired, the drops (commonly referred to as print drops) are not deflected and allowed to strike a print media. Alternatively, deflected drops can be allowed to strike the print media, while non-deflected drops are collected in the capturing mechanism.

After the non-print liquid drop contacts the catcher, it flows down the catcher face. Drag causes the liquid to slow down which can cause the liquid layer (also referred to as a liquid film) to become thicker. Increasing the thickness of the liquid film reduces the clearance between the liquid film and the print drops. If there is insufficient clearance between the liquid film and the print drops, the ink film can contact the print drops resulting in print defects.

As such, there is an ongoing effort to improve catcher performance in continuous printing systems.

SUMMARY OF THE INVENTION

According to an aspect of the present invention, a printhead includes a jetting module, a deflection mechanism, and a catcher. The jetting module includes a linear array of nozzles extending in a direction along a length of the jetting module with the linear array of nozzles having a pitch. The jetting module is configured to form liquid drops travelling along a first path from a plurality of liquid jets emitted from the nozzles. The deflection mechanism is configured to cause selected liquid drops formed by the jetting module to deviate from the first path and begin travelling along a second path. The catcher is positioned to intercept liquid drops travelling along one of the first path and the second path. The catcher includes a drop contact surface and a liquid removal conduit connected in fluid communication with each other by a Coanda surface including a radial surface including an array of grooves. The liquid removal conduit includes a surface that is positioned opposite and spaced apart from the radial surface that includes the array of grooves such that the opposite surface of the liquid removal conduit does not contact the radial surface that includes the array of grooves.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
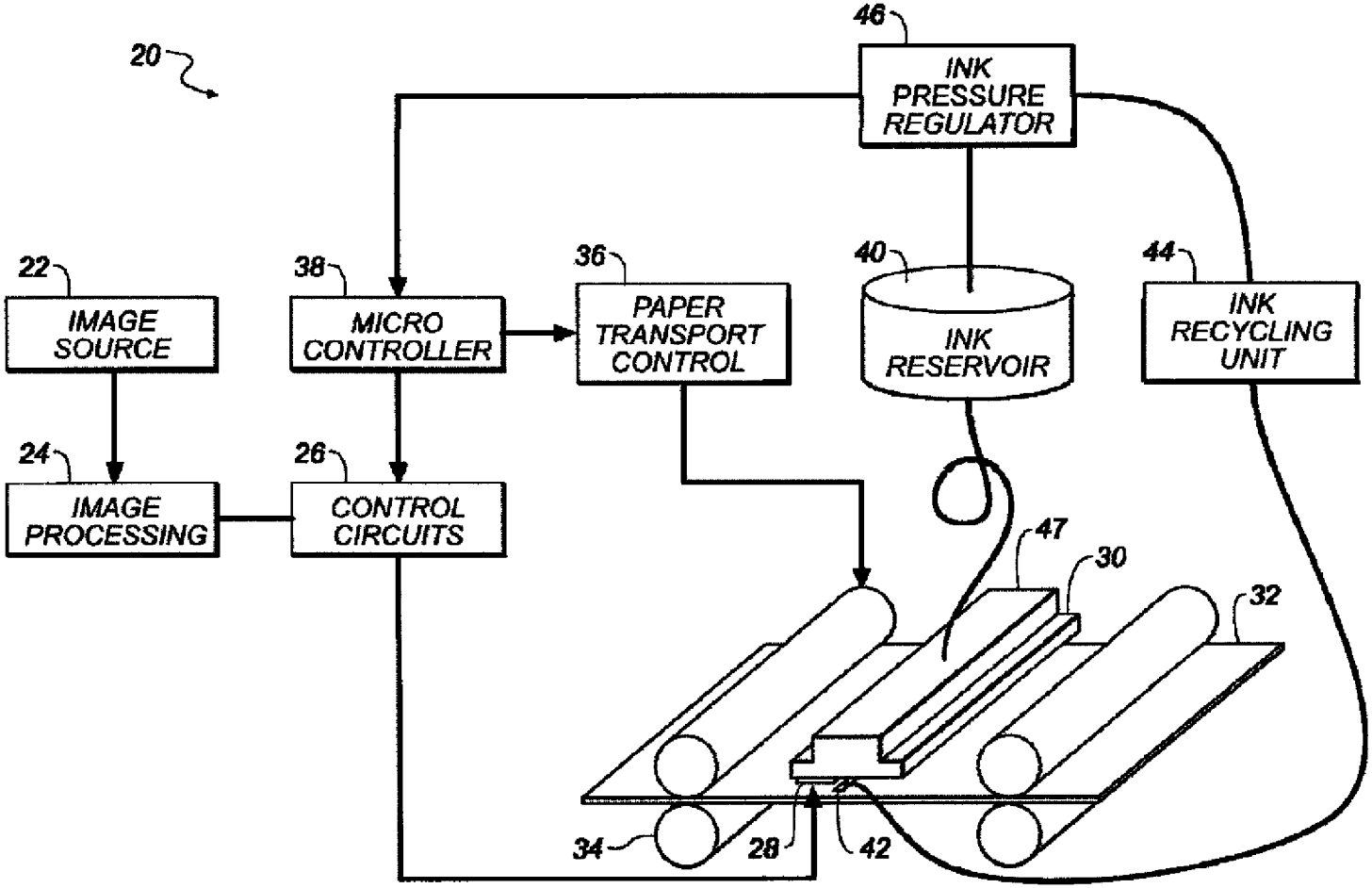
FIG. 1 shows a simplified block schematic diagram of an example embodiment of a printer system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous ink jet printer system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 reads data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
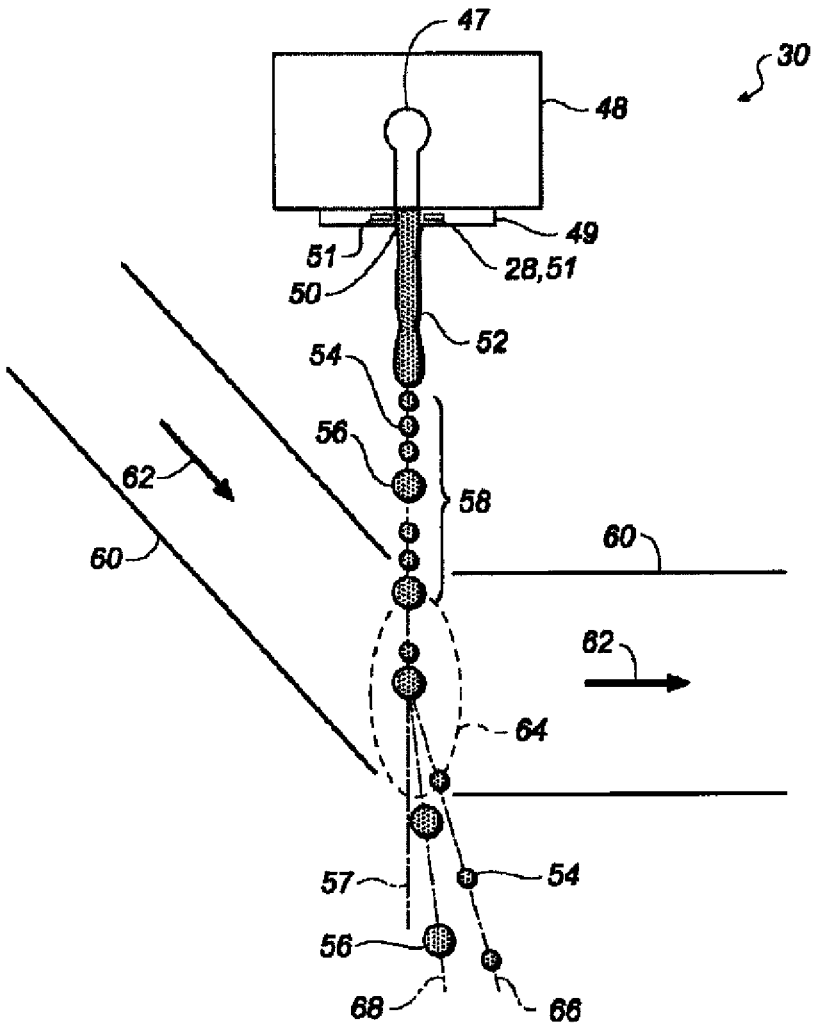
FIG. 2 is a schematic view of an example embodiment of a continuous printhead made in accordance with the present invention.
Figure 3:
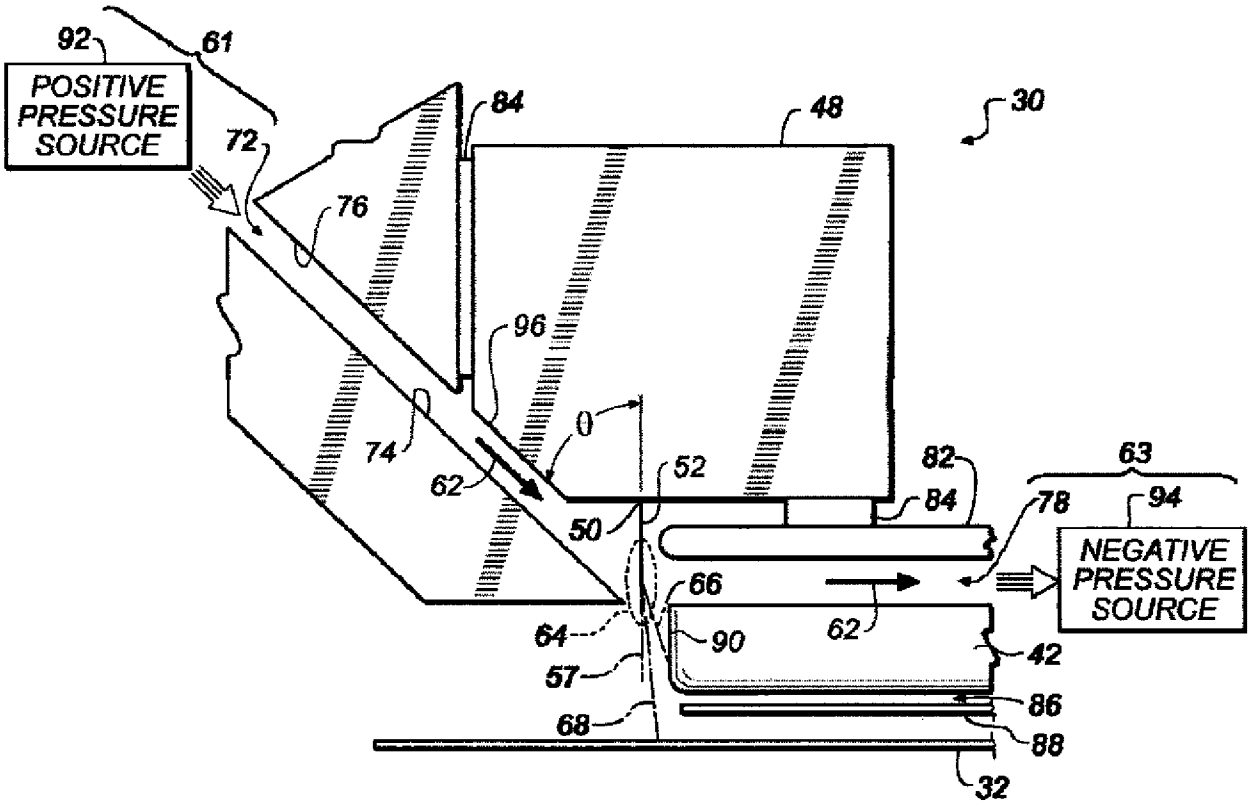
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size and liquid drops having a second size through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51 located in a nozzle plate 49 on one or both sides of nozzle 50. This type of drop formation is known and has been described in, for example, one or more of U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes, for example, in the form of large drops 56, a first size, and small drops 54, a second size. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas supplied from a positive pressure source 92 at downward angle θ of approximately a 45° toward drop deflection zone 64. An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. The front face of the catcher is commonly called the drop contact surface of the catcher as this is the surface against which the drops make contact with the catcher. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. As shown in FIG. 3, catcher 42 is a type of catcher commonly referred to as a "Coanda" catcher.

The present invention is not limited to use with the specific drop deflection mechanism or drop forming mechanism described above. For example, an electrostatic deflection mechanism can be used in place of a gas flow deflection mechanism, and a piezoelectric drop forming device can be used in place of a thermal drop forming device. The particular drop deflection or drop forming mechanisms selected depend on the specific application contemplated.

Figure 4:
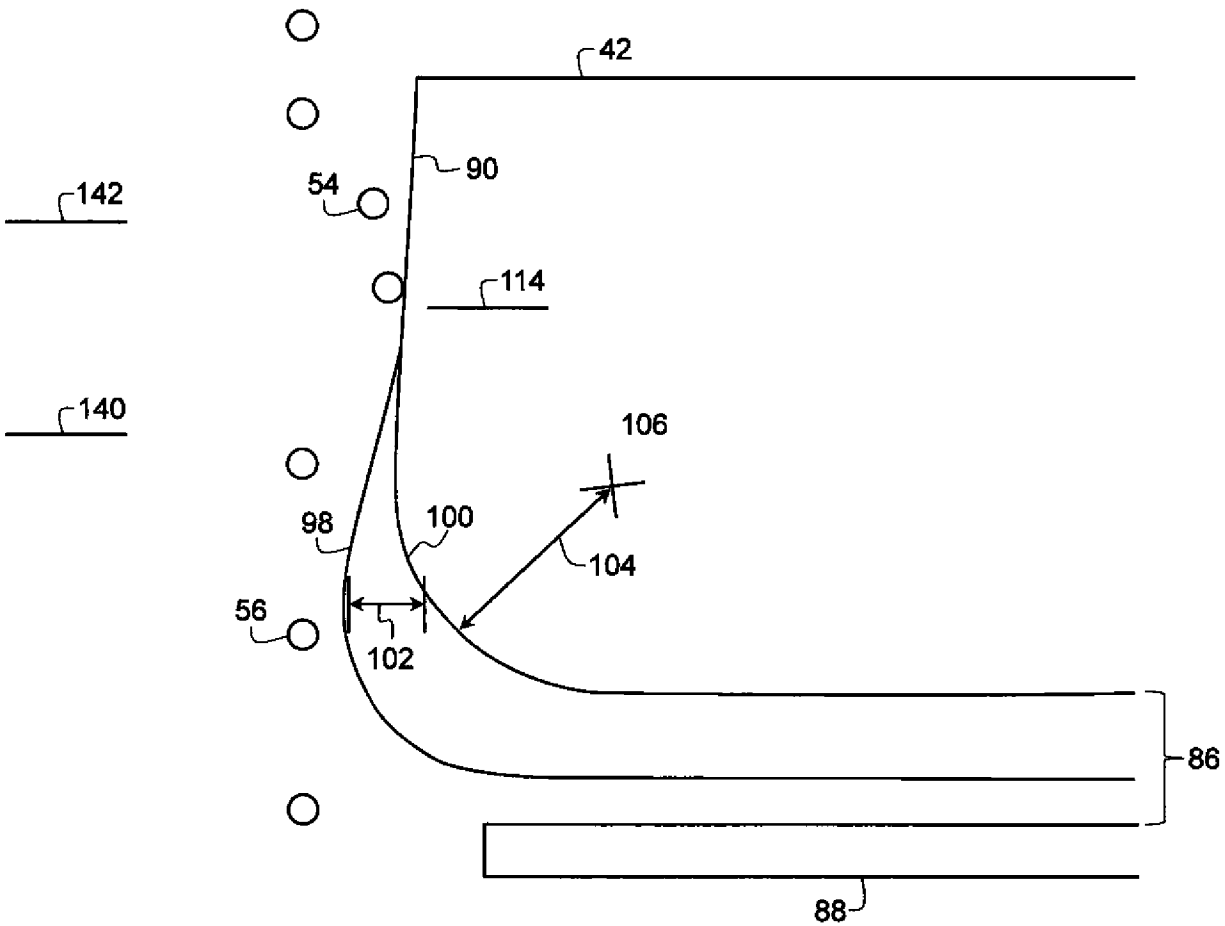
FIG. 4 (PRIOR ART)
FIG. 4 is a schematic cross sectional view of a prior art catcher.

Referring to FIG. 4, the non-print drops 54 impinge on the front face 90 of the catcher 42. The liquid from these drops, still retaining the downward momentum of the drops, flows down the face toward the ink removal duct 86 either as individual rivulets of ink for drops from each jet or as a continuous film or sheet of ink spanning the array of jets. For simplicity, the ink layer, whether in the form of individual rivulets or as a continuous film, will be referred to as an ink film 98. The phrase flow down the face of the catcher, as used in this application, is the liquid flow along the catcher face from the position at which the drops impinge the catcher face and move toward the liquid return duct 86 independent of the orientation of the printhead. The Coanda effect causes the liquid to stay attached to the surface of the catcher as it flows down the catcher face and around the radial surface 100 to flow into a liquid return duct 86 located or formed between catcher 42 and a plate 88. As the Coanda effect causes liquid to stay attached to the surface, this surface of the catcher is called a Coanda surface. The radial surface of the catcher, which typically has a constant radius of curvature, is called the radial portion of the Coanda surface. Ink entering the liquid return duct 86 is evacuated from there by means of a negative pressure source 97 and may be returned to the ink reservoir (shown in FIG. 1) for reuse or the ink can be disposed of.

As the ink flows down the catcher face 90, drag causes the liquid to slow down, which causes the layer of ink to become thicker. Increasing the thickness 102 of the ink film 98 reduces the clearance between the ink film 98 and the print drops 56. If there is insufficient clearance between the ink film 98 and the print drops 56, the ink film can contact the print drops causing these print drops to be either captured by the ink film on the catcher or deflected sufficiently that they fail to strike the recording media 32 at the desired location. This print defect is commonly referred to as a pickout print defect.

It has been found that the ink film thickness can be reduced by lowering the impact height 114 of the non-print drops 54 on the front face 90 of the catcher. This is due to the reduced distance that the ink film travels on the front face of the catcher, and over which drag can slow down the ink film, before the liquid travels around the radial surface of the Coanda surface of the catcher to enter the liquid return duct. As a result, there is typically an upper impact height threshold 142 above which pickout print defects are seen as a result of the insufficient clearance between the ink film 98 and the print drops 56. Below the upper impact height threshold 142, the reduced ink film thickness 102 provides sufficient clearance between the print drops 56 and the ink film 98 so that the pickout print defect is eliminated.

Conventional techniques, see, for example, EP 1 013 425, have reduced the fluid drag by heating the ink to lower its viscosity. Polishing or buffing the catcher face also reduces the fluid drag on the catcher face. While these methods reduce the fluid drag, the reduction in fluid drag is not sufficient for some printing applications, especially those involving high viscosity inks or smaller drop sizes.

It has also been found that too low of an impact height of the non-print drops on the front face 90 also leads to a print defect, commonly referred to as dark defect. This defect is the result of the non-print drops striking the front face of the catcher. It is thought that the ink film still has sufficient momentum at least locally such that the ink doesn't stay attached to the catcher face as it rounds the radial surface 100 of the catcher. Some of the ink then slings off the radial surface of the catcher and strikes the recording media 32. Since extra ink strikes the recording media in this situation, this print defect is known as dark defect. The impact height below which dark defect occurs is the lower impact height threshold 140.

Good quality print requires the drop impact height 114 to be lower than the upper impact height threshold 142 and above the lower impact height threshold 140. Ideally, there is a large operating window between the upper impact height threshold and the lower impact height threshold. Typically, the operating window between the onsets of the two types of print defects described above is measured in terms of a control parameter of the drop deflection system. For example, the print window can be measured in terms of the difference in gas flow rates for the drop deflection gas flow between the flow rate below which dark defect occurs and the flow rate above which the pickout defect. Unfortunately, the print or operating window tends to shrink when higher the viscosity inks are used.

Figure 5:
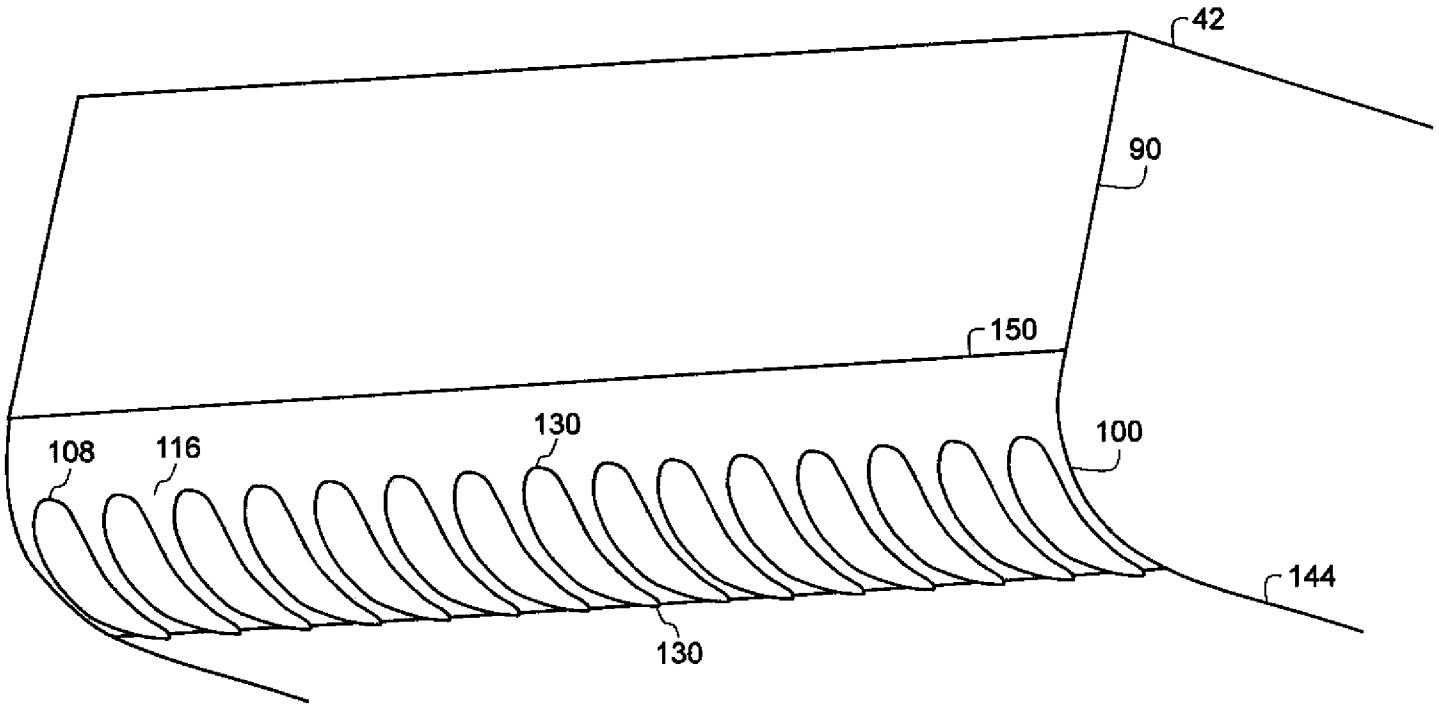
FIG. 5 is a partial schematic isometric view of an example embodiment of a catcher made in accordance with the present invention.

The present invention helps increase the print window. It does this by altering the geometry of the catcher 42 in the vicinity of the radial surface of the catcher. FIG. 5 shows an isometric view of a catcher 42, showing the front face 90 and the radial surface 100. The bottom plate of the catcher has been removed in FIG. 5 to provide a better view of the grooves. Rather than have a uniform radial surface 100 along the entire width of the catcher face, a linear array of grooves 108 has been formed in the radial surface 100. The walls of these grooves are hydrophilic so that the liquid readily wets the walls of the grooves and the liquid can flow freely through the grooves from the front face 90 of the catcher to the lower face 144 of the catcher into the liquid return channel. The grooves 108 provide a chamfered transition between the front face 90 of the catcher and the lower face 144 of the catcher body that is distinct from the radial surface 100 between the front face 90 and the lower face 144 that remains in the land area 116 between the grooves 108. A portion of the ink striking the front face 90 of the catcher 42 flows through the grooves 108 to the lower face 144 of the catcher and the liquid return duct 86. The remainder of the ink flows down the front face and around the radial surface 100 of the Coanda surface to the lower face 144 of the catcher and the liquid return channel 86.

Figure 7:
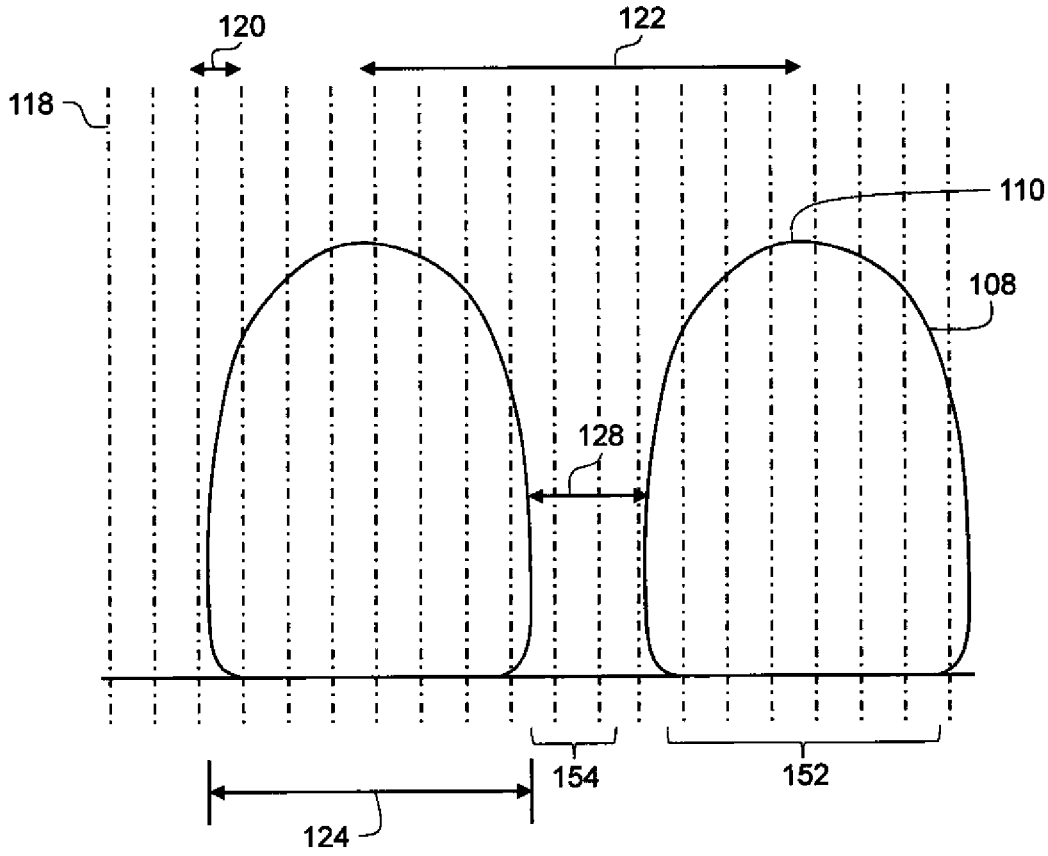
FIG. 7 is a partial schematic front view of another example embodiment of a catcher made in accordance with the present invention.

FIG. 7 shows a front view of a portion of the catcher 42. The pitch or spacing 122 of the grooves 108 is larger than the pitch or spacing 120 of the nozzles, the lines 118 in FIG. 7 correspond to the trajectories of drops from each of the nozzles or the linear array of nozzles. In a preferred embodiment, the pitch of the array of grooves is greater than three times the pitch of the linear array of nozzles. In a more preferred embodiment, the pitch of the array of grooves is greater than five times the pitch of the linear array of nozzles. In an even more preferred embodiment, the pitch of the array of grooves is greater than or equal to ten times the pitch of the linear array of nozzles. This is in contrast to prior art catchers with grooves that have the same pitch as the pitch of the nozzle array. In such prior art catchers, the grooves served to separate the liquid film on the catcher face into individual rivulets for each jet stream. As the grooves associated with each jet were similar, each stream of drops encountered essentially the same catcher profile as each of the other jets. While such a system can be useful, the pitch of the grooves must be well matched to the pitch of the jets and the grooves of the catcher need to be properly aligned with the nozzle array for proper operation. As the pitch of the jet arrays increases and the array lengths increases, such a matching of the pitch of the grooves to the pitch of the nozzles becomes extremely difficult to achieve. The catcher 42 of the present invention with the pitch of the grooves being relatively much larger than the pitch of the nozzles doesn't require a precise match of the nozzle pitch to the groove pitch.

The design of prior art catchers was such that the ink flowed as individual rivulets in each of the grooves, with the land area between the grooves separating the ink rivulets. With the catcher of the present invention, the land area 128 between the grooves no longer separates the flow of ink into the liquid return channel into individual rivulets. With the groove structure of the present catcher, a portion of the ink striking the front face 90 of the catcher 42 flows through the grooves 108 to the lower face 144 of the catcher and the liquid return duct 86, while the remainder of the ink flows down the front face, around the radial surface 100 of the Coanda surface to the lower face 144 of the catcher and the liquid return channel 86. The ink from the group of nozzles 152, which align with the groove 108, will flow through the groove to the lower face of the catcher, while the ink from the group of nozzles 154, which align with the land area 116 between the grooves, will flow along the radial surface 100 to the lower face 144 of the catcher.

Figure 6:
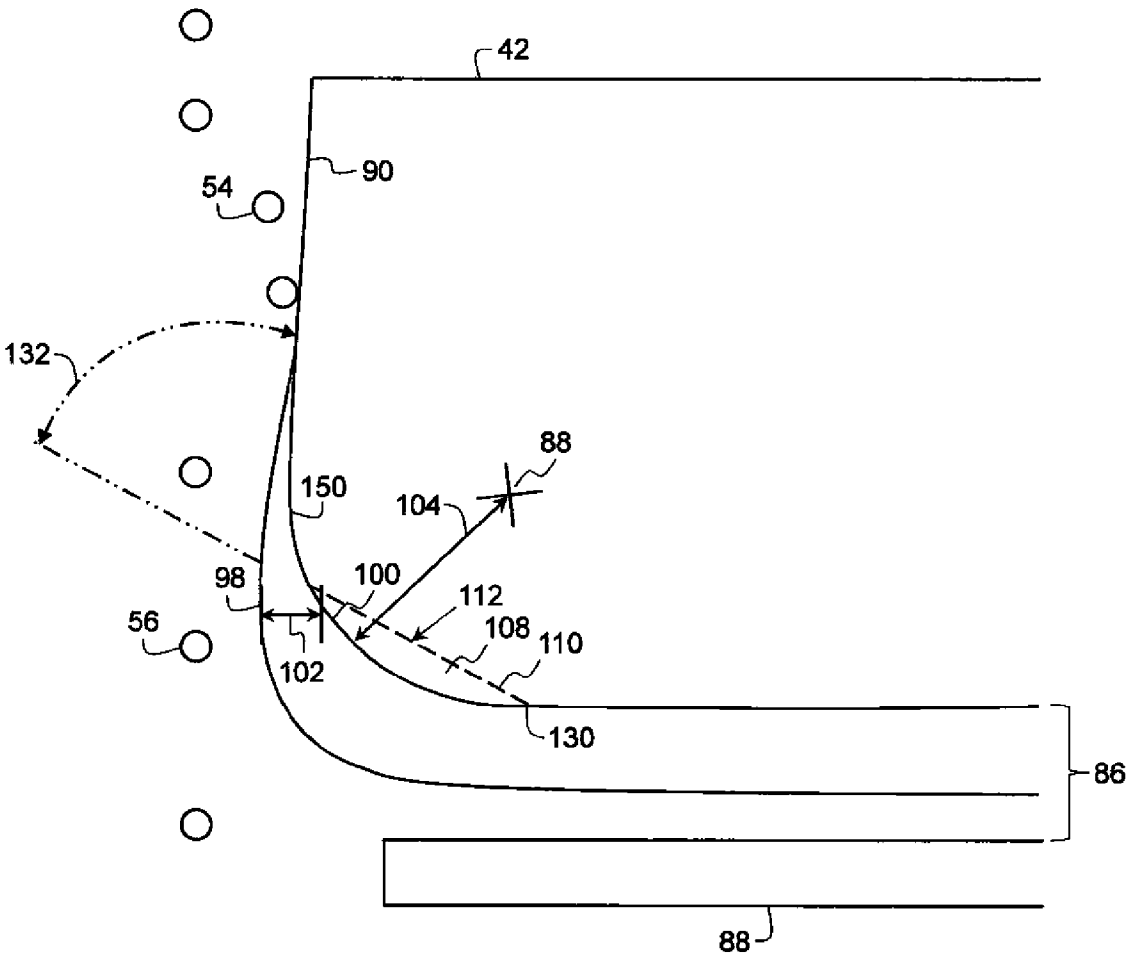
FIG. 6 is a schematic cross sectional side view of another example embodiment of a catcher made in accordance with the present invention.

In prior art catchers where the grooves served to separate the liquid flow into separate rivulets, the grooves were cut with a uniform depths as they wrapped from the front face of the catcher around the radial surface of the Coanda surface and into the liquid return channel, so that the grooves followed the contour of the outer surface of the catcher. In contrast to the prior art, the grooves of the invention don't follow the contour of the outer face of the catcher, but rather vary in depth 112 along the length of the groove. The depth 112 of a groove varies along the radial surface as viewed relative to the drop contact surface and the surface of the liquid removal conduit that is adjacent to the Coanda surface. As seen in FIG. 6, the depth 112 of a groove is larger near the midpoint of the groove, at a position along the groove that is remote from the ends 130 of the grooves than the depth of the groove near either end 130 of the groove.

Figure 9:
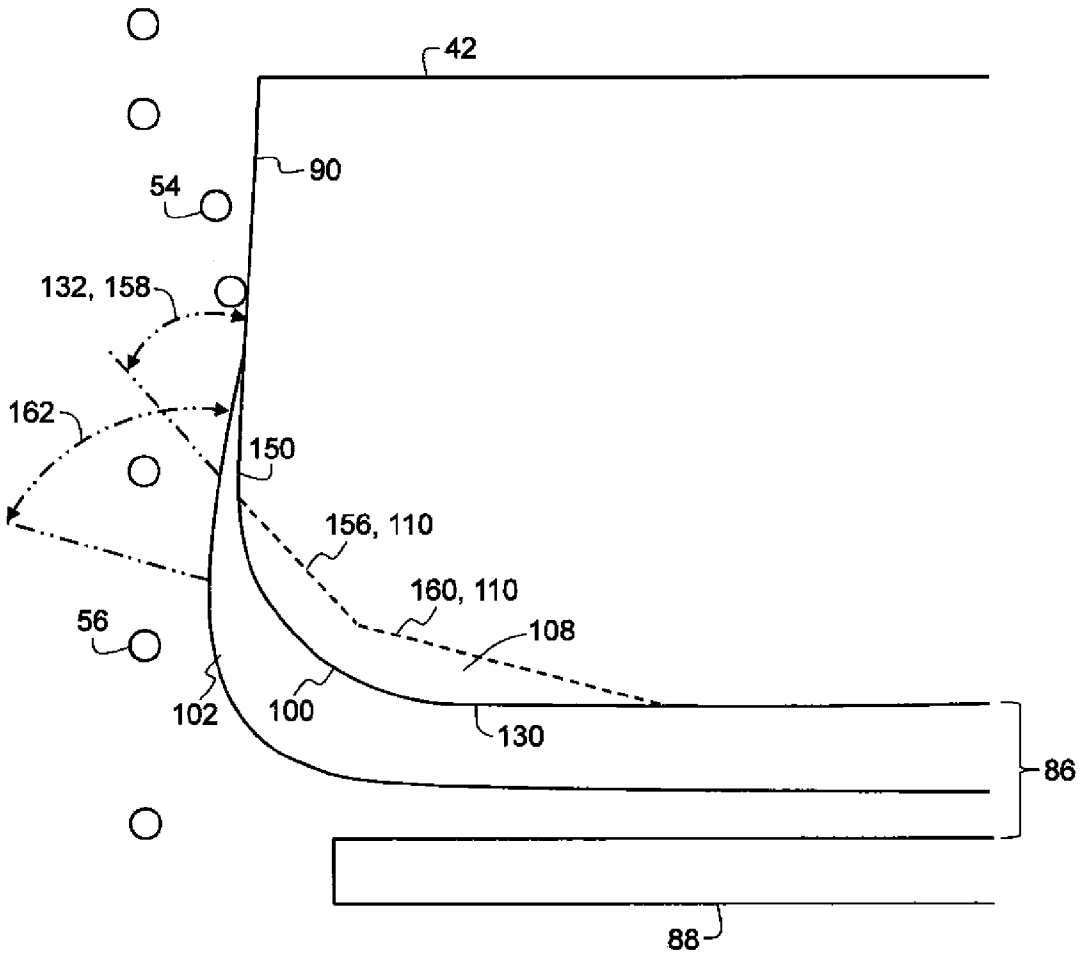
FIG. 9 is a schematic cross sectional side view of another example embodiment of a catcher made in accordance with the present invention.

In the embodiment shown in FIG. 6, the upper portion or top of each groove 110, that is the portion of the groove with the greatest amount of recess relative to the radial surface of the Coanda surface, is a line as the groove spans from the front face 90 of the catcher to the lower face 144 of the catcher body 42. The angle 132 of this line, measured relative to the face of the catcher as shown in FIG. 6 is less than or equal to 90 degrees. Preferably the angle 132 of the upper portion of the groove is in the range of 50 to 70 degrees relative to the face of the catcher. FIG. 9 shows another embodiment in which a first portion 156 of the top 110 of the groove 108 is positioned at the first angle 158 relative to the drop contact surface 90 of the catcher and a second portion 160 of the top 110 of the groove 108 is positioned at a second angle 162 relative to the drop contact surface 90 of the catcher. The embodiment shown in FIG. 9 reduces the angle between the drop contact face and the first portion of the top of the groove when compared to the embodiment of FIG. 6, so that the fluid flow transition from the drop contact face to the groove is smaller.

Preferably, the front of each groove intersects the Coanda surface of the catcher approximately at the tangent point 150 of the radial surface, where the radial surface meets the straight portion of the Coanda surface on the front of the catcher. Alternatively, the front of each groove intersects the radial surface 100 of the Coanda surface slightly below the tangent point. FIG. 5, for example, shows the front of each groove 108 intersecting the radial face of the Coanda surface below the tangent point 150. This is in contrast to prior art grooved catchers where the grooves extend all the way up the front face of the catcher to the drop impact point on the catcher or higher. By not extending the grooves up past the tangent point 150 of the radial surface of the catcher, the catcher of the present invention provides a consistent profile across the width of the jet array so that the impact height of the drops on the front face of the catcher is unaffected by the grooves.

Referring back to FIG. 7, in a preferred embodiment, the width 124 of the grooves is much wider than the spacing between nozzles and preferably is greater than ¼ of the radius of curvature 104 of the radial surface of the Coanda surface of the catcher. It is also preferred that the width of the grooves is less than ½ the radius of curvature of the radial surface of the Coanda surface of the catcher. When the grooves are narrower than ¼ of the radius of curvature 104 of the radial surface, the drag of the liquid flow through the grooves is excessive, impeding the flow of ink the groove. As the width of the grooves increases, the relative amount of drag against the walls of the grooves decreases. When the grooves become too wide, the stability of the fluid flowing through the groove becomes decreased, allowing ink to detach as the fluid makes the transition from the front face 90 of the catcher to the lower face 144 of the catcher. While not being limited to a particular understanding of the fluid flow on the catcher, it is thought that the surface tension of the liquid flowing over the land areas between the grooves helps to stabilize the flow of the liquid in the grooves. On the other hand, it also is thought that the flow of the liquid in the grooves causes the liquid film to be recessed relative to the flow of the liquid film over the land areas. The recessed liquid surface on each side of the land area produces an inward curvature to the surface of the liquid on the land area. The surface tension of the liquid combined with the curvature of the liquid surface causes liquid to flow laterally from the land areas into the grooves so that the ink film thickness in the land areas is reduced relative to the ink film thickness in a conventional Coanda catcher that doesn't have grooves.

Figure 8:
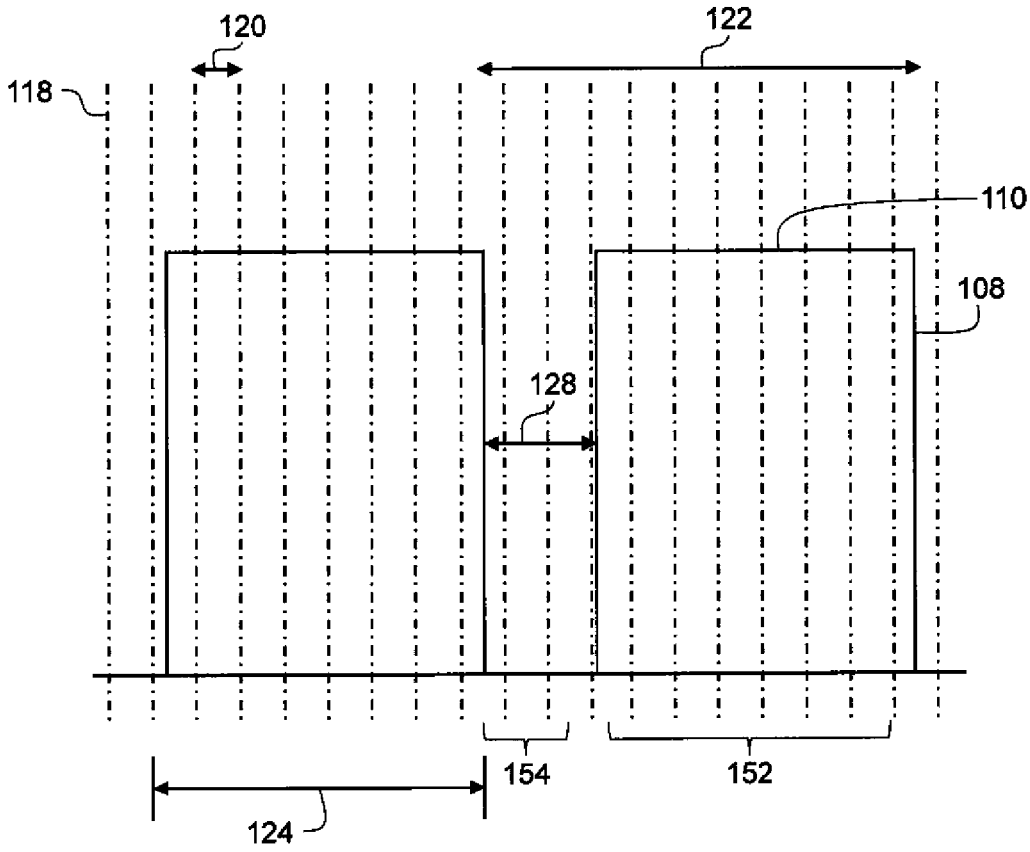
FIG. 8 is a partial schematic front view of another example embodiment of a catcher made in accordance with the present invention.

While the profile of the top 110 of the grooves shown in FIGS. 5 and 7 have an approximately semi-circular profile, other profiles can also be employed, such as the rectangular profile of the top 110 of the grooves 108 shown in FIG. 8.

Figure 10:
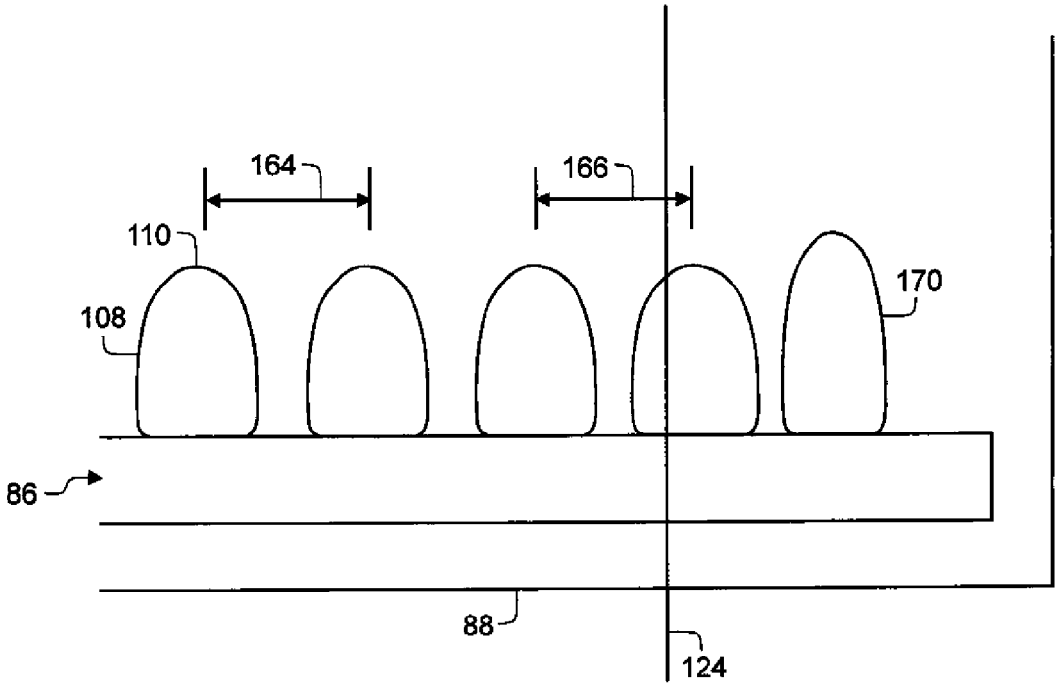
FIG. 10 is a partial schematic front view of another example embodiment of the catcher near an end of the jet array.

The liquid flow down the front face and the radial surface of the catcher at each end of the jet array can differ slightly from the liquid flow away from the ends of the array. To accommodate such variations in flow near the ends of the jet array, the pitch or spacing of the grooves can vary along the length of the array. As shown in FIG. 10, the grooves can have a first spacing 164 in the central portion of the catcher and a second spacing 166 near each end of the jet array. Line 168 denotes the right end of the jet array. To further accommodate flow variations near the ends of the jet array one or more grooves 170 can differ in height or width when compared to grooves 108 that are away from the ends of the jet array. In some embodiments, the spacing of the nozzles at the ends of the nozzle array is also varied relative to the nozzle spacing of nozzles away from the ends of the nozzle array. Typically such a variation in nozzle spacing would be limited to non-printing nozzles off each end of the array of printing nozzles. The presence of these non-printing nozzles, which produce guard drops, helps to maintain the uniformity of drop deflection all the way to the ends of the array of printing nozzles.

While not being limited to a particular understanding of the fluid flow on the catcher, it is thought that the grooves in the radial surface of the catcher enhance the print window by providing a significant increase in the depth of the liquid film which can more readily accommodate the slowing ink film. The liquid flow over the land area between the grooves seems to provide an anchor point for the liquid in the grooves which inhibits the detachment of the ink film that would otherwise occur at an abrupt transition between the front face of the catcher and a transition surface to the liquid return channel, such as the abrupt transition from the front face of the catcher to the top surface of the grooves.

The catcher with the array of grooves intersecting the radial surface of the Coanda surface of the catcher with the spacing and the width of the grooves being larger than the nozzle spacing has been found to enhance the operating window of the printhead. Relative to a conventional Coanda catcher that lacks the grooves, the present grooved catcher provides enhanced print windows for inks have viscosities greater than 2 cP, and more enhanced print windows yet for inks having viscosities of greater than 4 cP.

The invention has been described in detail with particular reference to certain preferred embodiments thereof, but it will be understood that variations and modifications can be effected within the scope of the invention.

PARTS LIST

20 Continuous Ink Jet Printer System
22 Image Source
24 Image Processing Unit
26 Mechanism Control Circuits
28 Device
30 Printhead
32 Recording Medium
34 Recording Medium Transport System
36 Recording Medium Transport Control System
38 Micro-Controller
40 Reservoir
42 Catcher
44 Recycling Unit
46 Pressure Regulator
47 Channel
48 Jetting Module
49 Nozzle Plate
50 Plurality of Nozzles
51 Heater
52 Liquid
54 Drops
56 Drops
57 Trajectory
58 Drop Stream
60 Gas Flow Deflection Mechanism
61 Positive Pressure Gas Flow Structure
62 Gas
63 Negative Pressure Gas Flow Structure
64 Deflection Zone
66 Small Drop Trajectory
68 Large Drop Trajectory
72 First Gas Flow Duct
74 Lower Wall
76 Upper Wall
78 Second Gas Flow Duct
82 Upper Wall
86 Liquid Return Duct
88 Plate
90 Front Face
92 Positive Pressure Source
94 Negative Pressure Source
96 Wall
97 Negative Pressure Source
98 Film of Ink
100 Radial Surface
102 Thickness of film
104 Radius of Curvature
106 Center of Radius
108 Groove
110 Top of Groove
112 Depth of Groove

114 Impact Height
116 Land Area
118 Lines
120 Nozzle Spacing
122 Groove Spacing
124 Groove Width
126 Tangent Point
128 Land Area
130 End of Groove
132 Angle
134 Lines
140 Lower Impact Height Threshold
142 Upper Impact Height Threshold
144 Lower Face
150 Tangent Point
152 Group of Nozzles
154 Group of Nozzles
156 First Portion
158 First Angle
160 Second Portion
162 Second Angle
164 First Spacing
166 Second Spacing
168 End of Jet Array
170 Groove

The invention claimed is:

1. A printhead comprising:

a jetting module including a linear array of nozzles extending in a direction along a length of the jetting module, the jetting module being configured to form liquid drops travelling along a first path from a plurality of liquid jets emitted from the nozzles;

a deflection mechanism configured to cause selected liquid drops formed by the jetting module to deviate from the first path and begin travelling along a second path; and a catcher positioned to intercept liquid drops travelling along one of the first path and the second path, the catcher including a drop contact surface and a liquid removal conduit connected in fluid communication with each other by a catcher surface including a radial surface including an array of grooves, the liquid removal conduit including a surface that is positioned opposite and spaced apart from the radial surface that includes the array of grooves such that the opposite surface of the liquid removal conduit does not contact the radial surface that includes the array of grooves.

2. The printhead of claim 1, wherein for a given groove of the plurality of grooves, the groove includes a depth that varies along the radial surface as viewed relative to the drop contact surface and the surface of the liquid removal conduit that is adjacent to the catcher surface.

3. The printhead of claim 2, the groove having an end, wherein the depth of the groove at a location spaced apart from the end of the groove is larger than the depth of the groove at the end of the groove.

4. The printhead of claim 2, the groove including a semi-circular profile.

5. The printhead of claim 2, the groove including a profile, the profile including an angle that is less than or equal to 90 degrees.

6. The printhead of claim 2, wherein the groove intersects the radial surface of the catcher surface of the catcher.

7. The printhead of claim 1, wherein for a given groove of the plurality of grooves, the groove is positioned at an angle relative to the drop contact surface.

8. The printhead of claim 7, the angle of the groove being a first angle, wherein for the given groove of the plurality of grooves, a first portion of the groove is positioned at the first angle relative to the drop contact surface and a second portion of the groove is positioned at a second angle relative to the drop contact surface.

9. The printhead of claim 7, the grooves of the plurality of grooves including a semi-circular profile.

10. The printhead of claim 7, the grooves of the plurality of grooves including a profile, the profile including an angle that is less than or equal to 90 degrees.

11. The printhead of claim 7, wherein the angle of the grooves of the plurality of grooves intersects the radial surface of the catcher surface of the catcher.

12. The printhead of claim 1, the linear array of nozzles having a pitch, the array of grooves extending in the same direction as that of the linear array of nozzles, the array of grooves having a pitch, the pitch of the array of grooves being greater than the pitch of the linear array of nozzles.

13. The printhead of claim 12, wherein the pitch of the array of grooves is greater than 3 times the pitch of the linear array of nozzles.

14. The printhead of claim 12, wherein the pitch of the array of grooves is greater than 5 times the pitch of the linear array of nozzles.

15. The printhead of claim 12, wherein the pitch of the array of grooves is greater than or equal to 10 times the pitch of the linear array of nozzles.

16. The printhead of claim 12, wherein the pitch of the array of grooves varies along the catcher in the same direction as that of the linear array of nozzles.

17. The printhead of claim 1, the radial surface of the catcher surface including a radius of curvature, a groove of the array of grooves including a width, wherein the width of the groove is less than ½ of the radius of curvature of the radial surface of the catcher surface.

18. The printhead of claim 1, the radial surface of the catcher surface including a radius of curvature, a groove of the array of grooves including a width, wherein the width of the groove is greater than ¼ of the radius of curvature of the radial surface of the catcher surface.

19. The printhead of claim 1, a groove of the array of grooves including side walls, wherein the side walls of the groove are hydrophilic.

* * * * *